US008051900B2

(12) United States Patent
Chang

(10) Patent No.: US 8,051,900 B2
(45) Date of Patent: Nov. 8, 2011

(54) INTERNAL JET INPINGEMENT TYPE SHELL AND TUBE HEAT EXCHANGER

(75) Inventor: Tong-Bou Chang, Yung-Kang (TW)

(73) Assignee: Southern Taiwan University of Technology, Tainan County (TW)

( * ) Notice: Subject to any disclaimer, the term of this patent is extended or adjusted under 35 U.S.C. 154(b) by 493 days.

(21) Appl. No.: 12/292,421

(22) Filed: Nov. 19, 2008

(65) Prior Publication Data

US 2009/0194261 A1 Aug. 6, 2009

(30) Foreign Application Priority Data

Jan. 31, 2008 (TW) ..... 97103829 A

(51) Int. Cl.
*F28D 5/02* (2006.01)
*A23C 3/04* (2006.01)

(52) U.S. Cl. ..... 165/115; 165/117

(58) Field of Classification Search ..... 165/113, 165/115, 117, 226, 157; *F28D 5/02*
See application file for complete search history.

(56) References Cited

U.S. PATENT DOCUMENTS

| | | | | | |
|---|---|---|---|---|---|
| 751,058 | A | * | 2/1904 | Cracknell | 202/163 |
| 1,776,349 | A | * | 9/1930 | Delas | 165/117 |
| 1,937,802 | A | * | 12/1933 | Baer | 62/394 |
| 2,047,459 | A | * | 7/1936 | Chamayou | 165/81 |
| 3,213,935 | A | * | 10/1965 | Reid, Jr. | 165/117 |
| 4,141,410 | A | * | 2/1979 | Takada | 165/113 |
| 5,588,596 | A | * | 12/1996 | Hartfield et al. | 239/542 |
| 2004/0112573 | A1 | * | 6/2004 | Moeykens | 165/115 |

FOREIGN PATENT DOCUMENTS

JP 61125588 A * 6/1986

* cited by examiner

*Primary Examiner* — Tho V Duong
(74) *Attorney, Agent, or Firm* — Rosenberg Klein & Lee

(57) ABSTRACT

This invention relates to an internal jet impingement type shell and tube heat exchanger in which the jet cooling tubes and the heating tubes in shell and tube heat exchanger are formed either as a staggered tube bundle or as a square tube bundle, and the orifices on each jet cooling tube are provided according to the arrangement of tube bundle. Thus, the heat transfer performance of jet impingement type shell and tube heat exchanger is remarkably enhanced.

1 Claim, 7 Drawing Sheets

INTERNAL JET INPINGEMENT TYPE SHELL AND TUBE HEAT EXCHANGER

BACKGROUND OF THE INVENTION

1. Field of the Invention

This invention relates to an internal jet impingement type shell and tube heat exchanger, especially to an internal jet impingement type shell and tube heat exchanger in which the cooling jet tubes and the heating tubes are arranged together internally in the heat exchanger to conduct cooling by jet impingement in proximity area so as to increase heat transfer performance.

2. Brief Description of the Prior Art

So far, jet impingement cooling has been proved to be very efficient in cooling. However, it has been hardly seen in shell and tube heat exchanger due to the fact that liquid cooling medium is failed to impinge on the entire heat transfer surface, when the orifices are arranged on upper side of tube bundle. This will cause local dry-up effect on part of the heat transfer surface so that heat transfer efficiency becomes deteriorated. Generally, in a conventional prior art jet impingement cooling as shown in FIG. 6, four orifices are used to impinging cooling medium jet to the upper side of a staggered tube bundle having four rows. The heat transfer performance of the tubes of $2^{nd}$ and $4^{th}$ rows (from the upmost) is far worse than that of $1^{st}$ (the upmost row) and $3^{rd}$ rows, as the $1^{st}$ row is directly impinged by cooling medium jet and the $3^{rd}$ row, located right below the $1^{st}$ row, is cooled by the cooling medium dropped from the $1^{st}$ row. As few cooling medium is used to cool the $2^{nd}$ and the $4^{th}$ rows, heat transfer performance is quite low on those rows. Thus, if a denser arrangement of tube bundle is present in evaporator, the liquid drops jetted downward from orifices are not easy to impinge directly onto the lower tubes of the tube bundle.

In view of the above defect, inventor of the present invention has proposed a cooling medium collector, disclosed in Taiwanese Patent No. 344790, for the prevention of tube's dry-up as shown in FIG. 7 in which the cooling medium collector is fixed underside of each tube body. The cooling medium collector is an arc shape member on which clips are provided at both ends. The clips are spring clips of C shape which can clip on the tube body so that the associated arc shape member is able to be retained appropriately on each tube body. The cooling medium liquid coming down from both sides of the tube body enters into the gap between the tube body and the cooling medium collector. Therefore, the cooling medium liquid impinged on the upper part of each tube body and the cooling medium liquid accumulated on the collector forms an envelope on the tube body so as to avoid liquid dry-up on the tube body, in turn to achieve high heat transfer rate and to raise heat transfer efficiency. Thus, the liquid collector collects the liquid coming down along the periphery of each tube body and the liquid drops bouncing back so that the lower surface of each tube body can obtain sufficient cooling medium for cooling. In this manner, the occurrence of dry-up phenomenon is delayed or even eliminated. When the cooling medium collected by the collector is full, the overflow of cooling medium is designed to flow along an overflow guide and to fall onto the right upper side of the next row of tubes. Therefore, the incorporation of the liquid collector can raise heat transfer performance and attain high heat flux.

Encouraged by the success of the above liquid collector, inventor further proposes an internal jet impingement type shell and tube heat exchanger having its heat transfer performance superior than that of the above liquid collector, with a purpose to raise better heat transfer performance and attain higher heat flux.

SUMMARY OF THE INVENTION

The object of the present invention is to provide an internal jet impingement type shell and tube heat exchanger, characterized in that the orifices are arranged internally within the tube bundle so as to remarkably increase the heat transfer performance of the jet impingement type shell and tube heat exchanger.

In order to achieve the above object, an internal jet impingement type shell and tube heat exchanger of the present invention is provided in which the jet impingement cooling tubes and the heating tubes in shell and tube heat exchanger are formed either as a staggered tube bundle or as a square tube bundle, and the orifices on each cooling tube are provided according to the arrangement of tube bundle. Thus, the heat transfer performance of jet impingement type shell and tube heat exchanger is remarkably increased.

DETAILED DESCRIPTION OF THE PREFERRED EMBODIMENTS

The features, objects and functions of the present invention will become more apparent by the detailed description of a preferred embodiment of the present invention in conjunction with the accompanying drawings.

Figure 1:
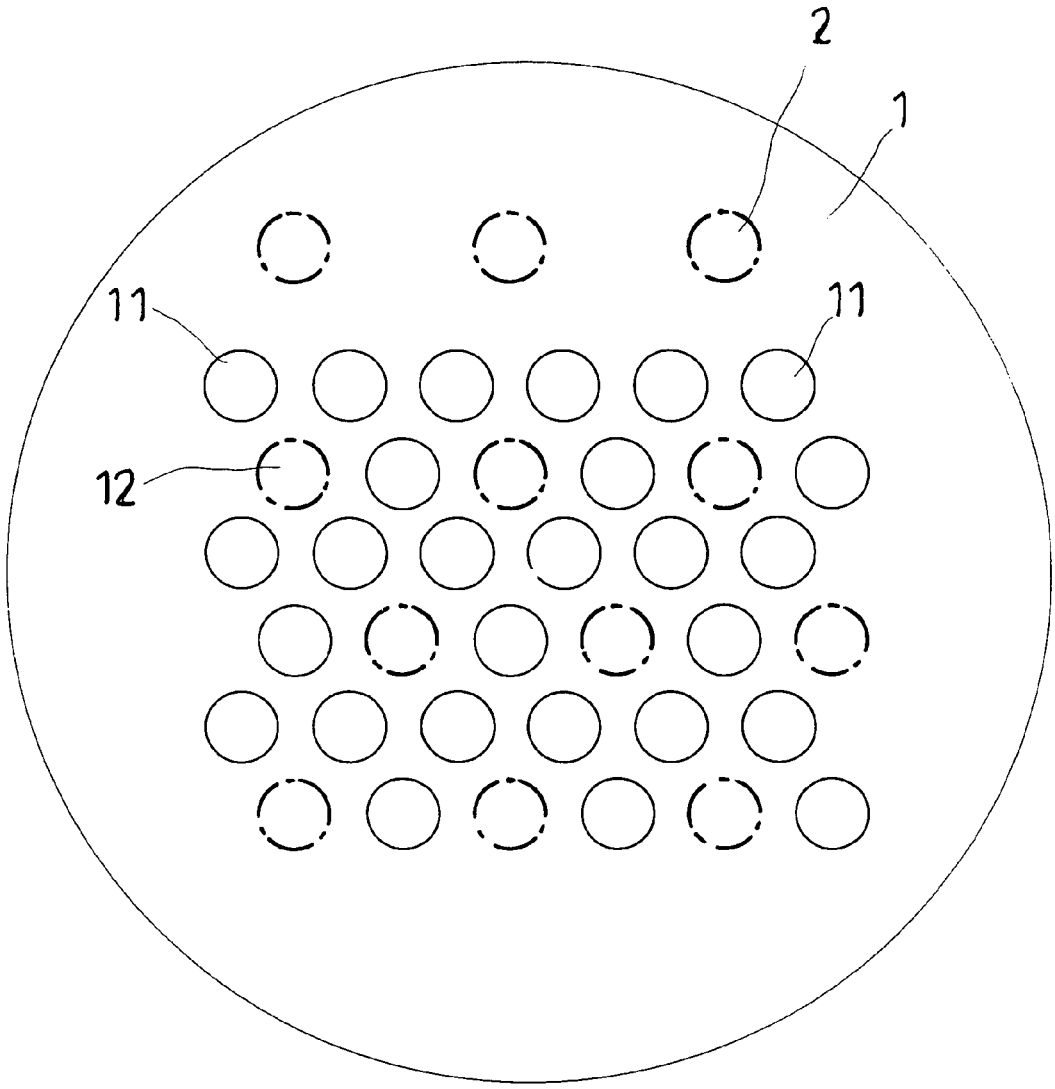
FIG. 1 is a schematic view of the first embodiment of the present invention.
Figure 2:
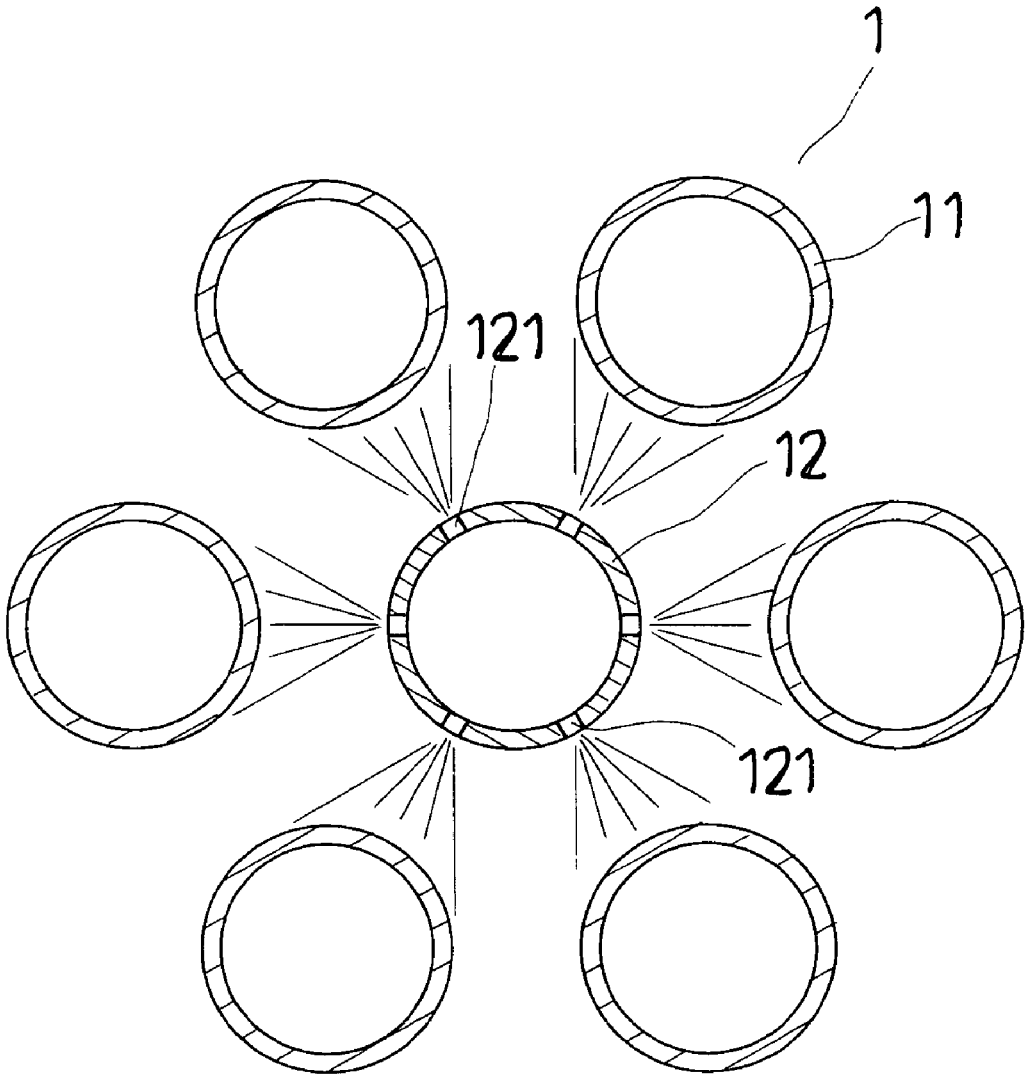
FIG. 2 is a partial enlarged schematic view of the first embodiment of the present invention.

Firstly referring to FIGS. 1 and 2 showing a schematic view of the first preferred embodiment of the present invention, heating tubes (11) and jet cooling tubes (12) are provided in a shell and tube type heat exchanger (1).

The entire heating tubes and the jet cooling tubes are formed as a staggered tube bundle, the $1^{st}$ row being provided as jet cooling tubes (12) which form triangular arrangement with the heating tubes (11) of the $2^{nd}$ row, one jet cooling tube (12) being interposed between every two heating tubes (11) in the $3^{rd}$, $5^{th}$, $7^{th}$ . . . rows, each jet cooling tube (12) being provided with orifices (121) directing to each adjacent heating tube (11).

Referring to FIG. 2 showing an partial enlarged schematic view of the first embodiment of the present invention, when the arrangement of the heating tubes (11) and the jet cooling tubes (12) in the shell and tube type heat exchanger (1) is configured as above, i.e., the heating tubes and the jet cooling tubes are arranged as a staggered tube bundle, the $1^{st}$ row being provided as jet cooling tubes (12) which form triangular arrangement with the heating tubes (11) of the $2^{nd}$ row, one jet cooling tube (12) being interposed between every two heating tubes (11) in the $3^{rd}$, $5^{th}$, $7^{th}$ . . . rows, each jet cooling tube (12) being provided with orifices (121) directing to each adjacent heating tube (11), the orifices (12) on right side of each jet cooling tube (12) in staggered tube bundle can jet cooling medium in three angles directing respectively to the heating tubes (11) at upper right, right and lower right sides. Similarly, the orifices (12) on another (left) side of each jet cooling tube (12) in staggered tube bundle can jet cooling medium in three angles directing respectively to the heating tubes (11) at upper left, left and lower left sides. In this manner, the heat transfer performance of the jet impingement type shell and tube heat exchanger is remarkably increased.

Figure 3:
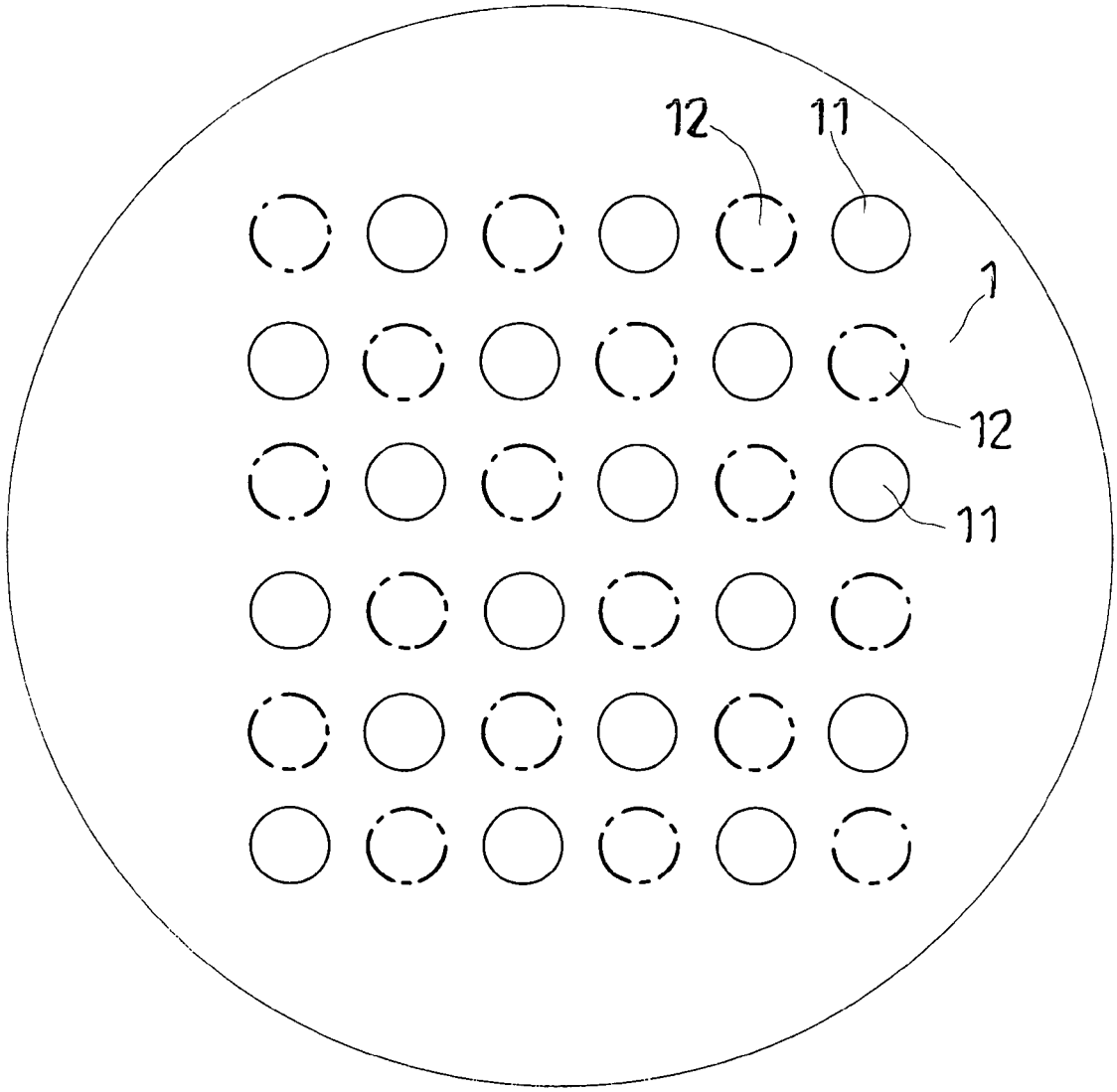
FIG. 3 is a schematic view of the second embodiment of the present invention.
Figure 4:
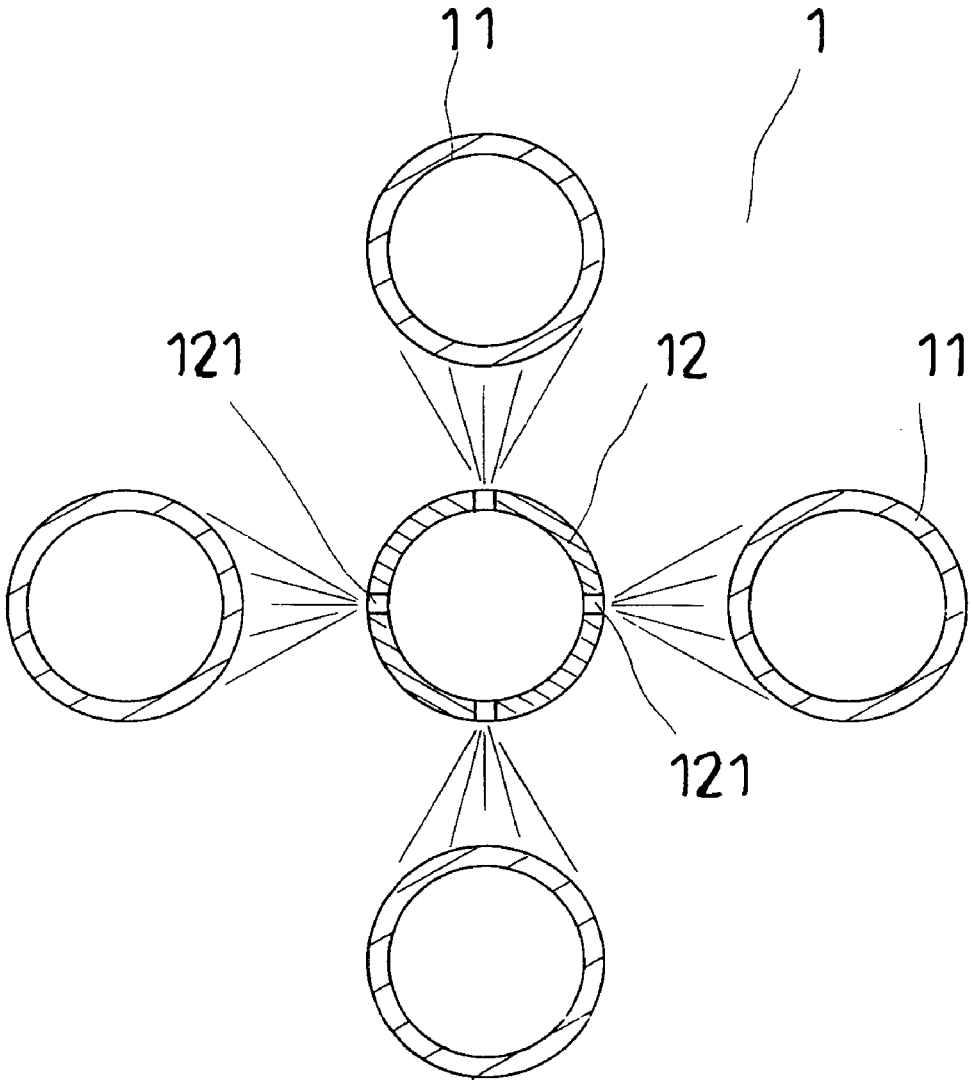
FIG. 4 is a partial enlarged schematic view of the second embodiment of the present invention.

Further referring to FIGS. 3 and 4 showing a schematic view of the $2^{nd}$ preferred embodiment of the present invention, heating tubes (11) and jet cooling tubes (12) are provided in a shell and tube type heat exchanger (1).

The heating tubes (11) and the jet cooling tubes (12) are arranged as a square tube bundle, and each jet cooling tubes (12) is provided with orifices (121) directing to each heating tube (11).

Referring to FIG. 4 showing an partial enlarged schematic view of the $2^{nd}$ embodiment of the present invention, when the heating tubes (11) and the jet cooling tubes (12) are arranged as a square tube bundle, the orifices on each jet cooling tube (12) can jet cooling medium in four angles directing respectively to the heating tubes (11) at upright upper, right, straight lower and left sides. In this manner, the heat transfer performance of the jet impingement type shell and tube heat exchanger (1) is remarkably increased.

Figure 5:
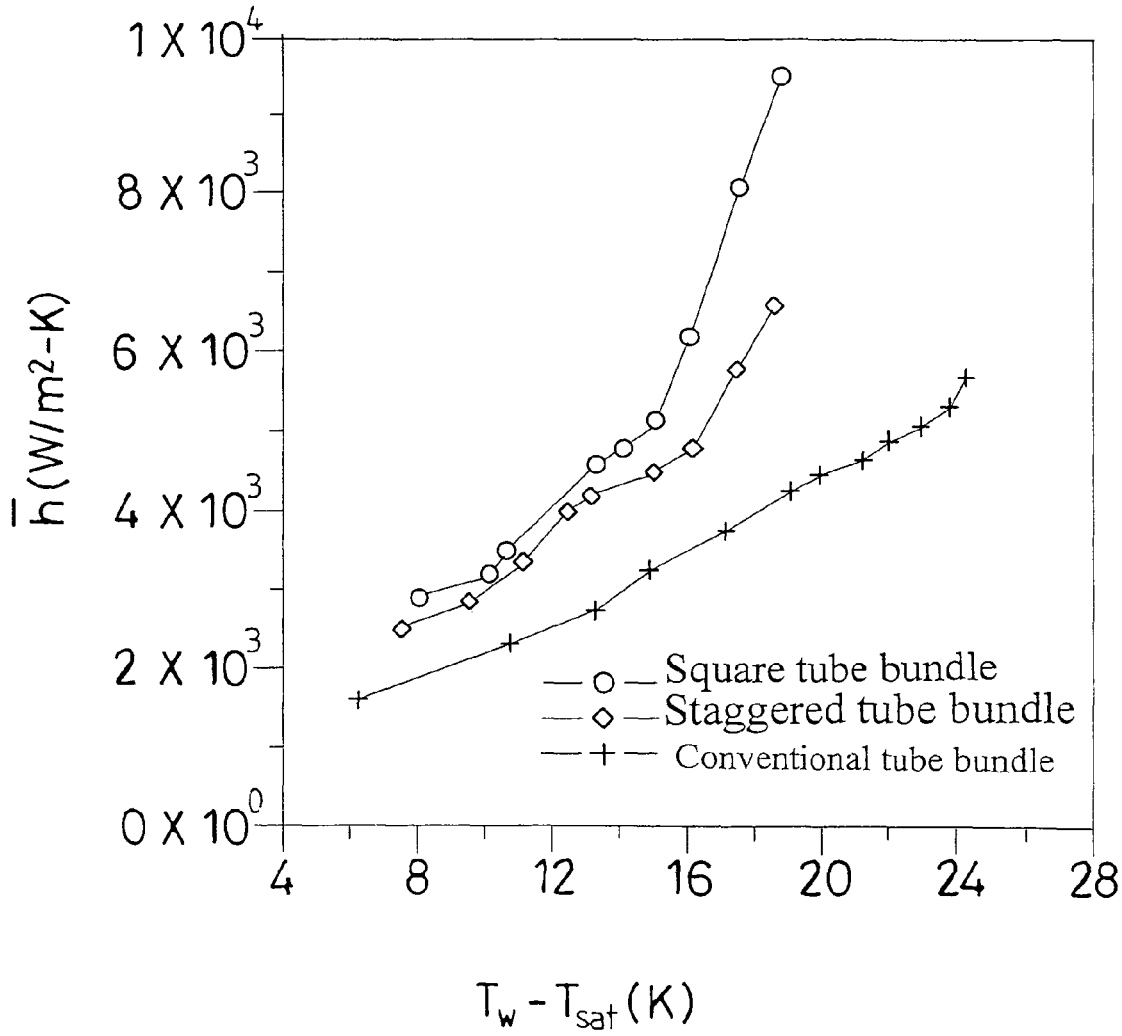
FIG. 5 is a comparison schematic view of the present invention.
Figure 6:
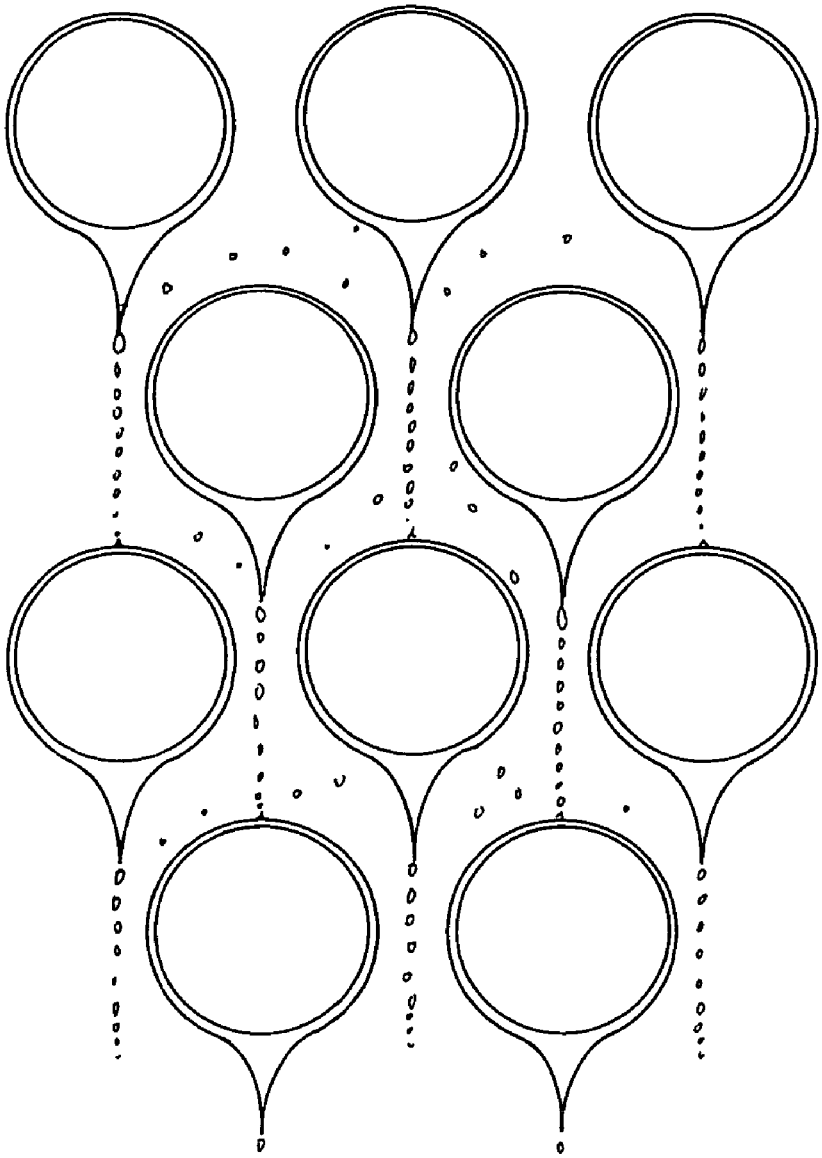
FIG. 6 (PRIOR ART)
FIG. 6 is a schematic view of a conventional jet impingement type cooling method.
Figure 7:
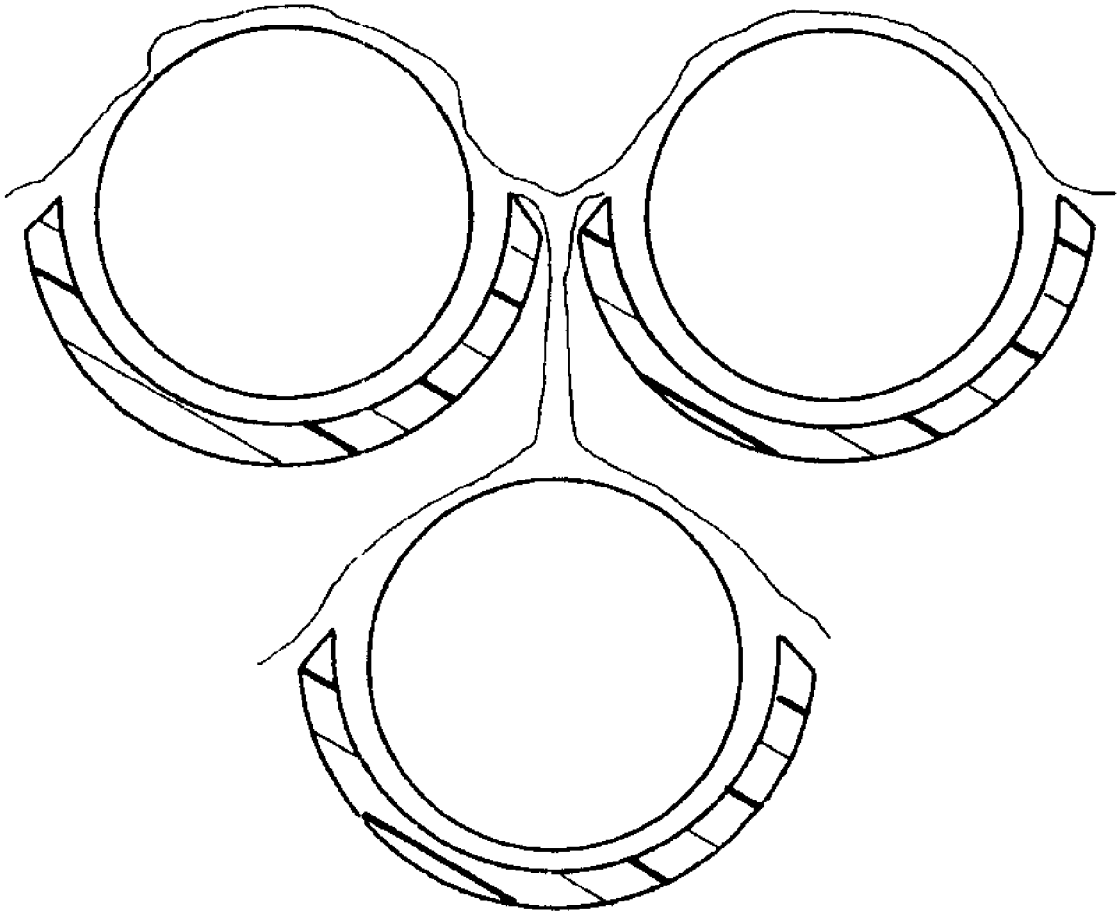
FIG. 7 (PRIOR ART)
FIG. 7 is a schematic view of conventional cooling medium collector.

Referring to FIG. 5 showing a comparison between the jet impingement heat transfer, with a staggered tube bundle and a square tube bundle, and conventional pool boiling heat transfer, in which ○ is square tube bundle, ◇ being staggered tube bundle, and + being conventional type. In the case of staggered tube bundle, the periphery of each heating tube (11) is impinged by cooling medium jet from two orifices (121). In the case of square tube bundle, each heating tube (11) has its straight upper, straight lower, left and right sides impinged by jet from one orifice (121)(i.e., each heating tube (11) is impinged by jet from four orifices (121)). It is noted from the curve in the Figure that the heat transfer performance in the case of jet impingement by four orifices (121) on each heating tube (11) (square tube bundle) is better than that of the case of jet impingement by two orifices (121) on each heating tube (11) (staggered tube bundle). However, both methods are far superior to conventional pool boiling method. Based on the above, this invention will have widespread application in engineering field.

The abovementioned are merely preferred embodiments of the present invention, and should not be considered as a limitation on the structural aspect and dimension of the present invention. Equivalent variations and modifications made by the person skilled in the art without departing from the spirit and scope of the present invention are still considered to be within the scope of claim of the present invention.

Based on the foregoing, the internal jet impingement type shell and tube heat exchanger of the present invention has the following advantages when compared with the prior art.

1. In the internal jet impingement type shell and tube heat exchanger of the present invention, jet cooling tubes and the heating tubes in shell and tube heat exchanger are formed either as a staggered tube bundle or as a square tube bundle, so as to greatly increase the heat transfer performance of jet impingement type shell and tube heat exchanger.

2. The present invention as abovementioned has excellent heat transfer performance and high heat flux.

3. As the present invention has abovementioned excellent heat transfer performance and high heat flux, market competitiveness of the heat exchanger can be enhanced.

Summing up above, the present invention can reach expected effectiveness, and the specific structures disclosed herein have yet not seen in the prior art of the same category of product, even has not been opened to the public before application.

What is claimed is:

1. An internal jet impingement type shell and tube heat exchanger, comprising the heating tubes and the jet cooling tubes are provided therein, wherein all said heating tubes and said jet cooling tubes are formed as a staggered tube bundle, the $1^{st}$ row being provided with jet cooling tubes which form triangular arrangement with the heating tubes of the $2^{nd}$ row, one jet cooling tube being interposed between every two heating tubes in the $3^{rd}$, $5^{th}$, $7^{th}$ . . . rows, each jet cooling tube being provided with orifices directing to each adjacent heating tube.

* * * * *

UNITED STATES PATENT AND TRADEMARK OFFICE

CERTIFICATE OF CORRECTION

PATENT NO. : 8,051,900 B2
APPLICATION NO. : 12/292421
DATED : November 8, 2011
INVENTOR(S) : Tong-Bou Chang It is certified that error appears in the above-identified patent and that said Letters Patent is hereby corrected as shown below:

On the Title Page, Item (54) and in the Specification, Column 1, Line 1, Title, please replace "INPINGEMENT" with --IMPINGEMENT--

Signed and Sealed this
Twenty-third Day of September, 2014

Michelle K. Lee

Michelle K. Lee
*Deputy Director of the United States Patent and Trademark Office*